US010591145B2

(12) United States Patent
Healey

(10) Patent No.: US 10,591,145 B2
(45) Date of Patent: Mar. 17, 2020

(54) LUMINAIRE

(71) Applicant: John Cullen Lighting Limited, London (GB)

(72) Inventor: Matthew Healey, South Croydon (GB)

(73) Assignee: John Cullen Lighting Limited, London (GB)

( * ) Notice: Subject to any disclaimer, the term of this patent is extended or adjusted under 35 U.S.C. 154(b) by 5 days.

(21) Appl. No.: 16/027,399

(22) Filed: Jul. 5, 2018

(65) Prior Publication Data

US 2019/0011115 A1 Jan. 10, 2019

(30) Foreign Application Priority Data

Jul. 5, 2017 (GB) ..... 1710806.9

(51) Int. Cl.
*F21V 15/00* (2015.01)
*F21V 21/04* (2006.01)
(Continued)

(52) U.S. Cl.
CPC ..... *F21V 21/047* (2013.01); *F21S 8/026* (2013.01); *F21V 17/14* (2013.01); *F21V 17/168* (2013.01);
(Continued)

(58) Field of Classification Search
CPC .... F21V 21/043; F21V 21/044; F21V 21/046; F21V 19/0055; F21S 8/026
(Continued)

(56) References Cited

U.S. PATENT DOCUMENTS 9,062,837 B2 * 6/2015 Wronski ..... F21S 8/02
2016/0290576 A1 * 10/2016 Briggs ..... F21V 15/01

FOREIGN PATENT DOCUMENTS

DE 202010001902 7/2010
EP 2322817 5/2011
(Continued)

OTHER PUBLICATIONS

Supplementary European Search Report and the European Search Opinion dated Sep. 24, 2018 From the European Patent Office Re. Application No. 18182034.1 (7 Pages).
(Continued)

*Primary Examiner* — Matthew J. Peerce

(57) ABSTRACT

A luminaire (1) comprises lamp holder (3) and a lamp (2) mountable to the lamp holder (3). The lamp holder (3) has a body (6) with a cylindrical inner surface (8) and protuberances (1) located around the cylindrical inner surface (8). The lamp has a housing (15) with faces (21) and groups of grooves (22*a*, 22*b*, 22*c*) around an outer surface. Each group of grooves (22*a*, 22*b*, 22*c*) is spaced away from a first end of the housing (15) by a different distance. The faces (21) facilitate insertion of the housing (15) into the body (6) at a first orientation by providing space for the protuberances (10) between the housing (15) and the cylindrical inner surface (8). The lamp (2) is rotatable in the lamp holder (3) from a first orientation to a second orientation in which the grooves of one of the groups of grooves (22*a*, 22*b*, 22*c*) accommodate the protuberances (10) to secure the lamp (2) to the lamp holder (3). The different groups of grooves (22*a*, 22*b*, 22*c*) secure the lamp (2) in different axial positions relative to the lamp holder (3). This allows optical elements (23, 24) of different thicknesses to be inserted between the lamp (2) and the lamp holder (3).

11 Claims, 7 Drawing Sheets

(51) Int. Cl.

| | |
|---|---|
| ***F21S 8/02*** | (2006.01) |
| ***F21V 21/14*** | (2006.01) |
| ***F21V 17/14*** | (2006.01) |
| ***F21V 17/16*** | (2006.01) |
| *F21Y 115/10* | (2016.01) |

(52) U.S. Cl.
CPC ..... *F21V 21/04* (2013.01); *F21V 21/14* (2013.01); *F21Y 2115/10* (2016.08)

(58) Field of Classification Search
USPC ..... 362/365
See application file for complete search history.

(56) References Cited

FOREIGN PATENT DOCUMENTS

| | | | |
|---|---|---|---|
| EP | 3118514 | | 1/2017 |
| GB | 2538244 | | 11/2016 |
| GB | 2538244 B | * | 5/2018 |
| WO | WO 2013/034009 | | 3/2013 |

OTHER PUBLICATIONS

Patents Act 1977: Search Report Under Section 17 dated Nov. 9, 2017 From the Intellectual Property Office of the United Kingdom of Great Britain Re. Application No. GB1710806.9. (4 Pages).

* cited by examiner

LUMINAIRE

RELATED APPLICATIONS

This application claims the benefit of priority of United Kingdom Patent Application No. 1710806.9 filed on Jul. 5, 2017, the contents of which are incorporated herein by reference in their entirety.

FIELD AND BACKGROUND OF THE INVENTION

The present disclosure relates to a luminaire comprising a lamp mountable to a lamp holder. The disclosure is particularly but not exclusively applicable to a recessed downlight, and to a lamp that is replaceable in the lamp holder.

A recessed light is a type of luminaire that is installed in a hole in a panel with its bulk in the hole or on one side of the panel, and flush with the other side of the panel. A recessed light may have a lamp holder for accommodating a lamp in the recess behind the hole in the panel. The lamp holder may be open through the panel to allow fitting of a lamp in the lamp holder. Alternatively, the lamp holder may be removable from the hole to allow the lamp to be fitted into the lamp holder. This arrangement is favoured for more modern recessed lights, as more modern recessed lights tend to use lamps that require replacement relatively infrequently, such as Light Emitting Diode (LED) engines.

There are numerous arrangements for fitting lamps in the form of light bulbs, e.g. halogen or incandescent light bulbs, into lamp holders by securing the light bulb via its electrical connection. These include screw thread and bayonet fittings, as well as plug and socket arrangements. However, combining the physical mounting of the lamp with its electrical connection can result in the physical mounting being fragile and/or the electrical connection being unreliable. There is also an increased risk that the user will receive an electric shock when changing the lamp, as the user may inadvertently touch the electrical connection whilst manipulating the lamp in the lamp holder.

More modern lights separate the physical mounting and the electrical connection. The lamp may be associated with a flexible lead that has a plug and socket arrangement remote from the lamp for making the electrical connection. The physical mounting may involve a body of the lamp, separate to the lead and electrical connection. For example, fasteners, such as screws or bolts, may be used to secure the lamp to the lamp holder. In other arrangements, a clip or clasp may be used to secure the lamp to the lamp holder. A problem with many of these arrangements is that they use loose components, such as the screws and clips. This makes the physical mounting cumbersome and complicated. Moreover, the risk of misplacing a loose component during the fitting process can be a nuisance.

The present disclosure seeks to overcome these problems.

SUMMARY OF THE INVENTION

According to a first aspect of the present disclosure, there is provided a luminaire comprising lamp holder and a lamp mountable to the lamp holder, wherein the lamp holder comprises:

a body with a cylindrical inner surface open at a first end of the body; and protuberances located at a first set of arcs around the cylindrical inner surface, each protuberance extending inwardly from the cylindrical inner surface, and wherein the lamp comprises:

a light source;

a housing to which the light source is mounted, the housing comprising a cylindrical part, an outer periphery of the cylindrical part at a first end of the housing extending radially less at a second set of arcs around the outer periphery of the cylindrical part than elsewhere around the outer periphery of the cylindrical part; and two or more groups of grooves in an outer surface of the cylindrical part, the grooves being located at a third set of arcs around the cylindrical part and each group of grooves being spaced away from the first end of the housing by a different distance, the second set of arcs coinciding with the first set of arcs when the lamp is mounted to the lamp holder at a first orientation and the third set of arcs coinciding with the first set of arcs when the lamp is mounted to lamp holder at a second orientation, such that the outer periphery of the cylindrical part extending radially less at the second set of arcs around the outer periphery of the cylindrical part than elsewhere around the outer periphery of cylindrical part facilitates insertion of the cylindrical part into the first end of the body at the first orientation by providing space for the protuberances between the cylindrical part and the cylindrical inner surface, and when the lamp is rotated in the lamp holder from the first orientation to the second orientation the grooves of one of the groups of grooves accommodate the protuberances to secure the lamp to the lamp holder.

According to a second aspect of the present disclosure, there is provided a lamp for mounting to a lamp holder, the lamp comprising:

a light source;

a housing to which the light source is mounted, the housing comprising a cylindrical part, an outer periphery of the cylindrical part at a first end of the housing extending radially less at a second set of arcs around the outer periphery of the cylindrical part than elsewhere around the outer periphery of the cylindrical part; and two or more groups of grooves in the outer surface of the cylindrical part, the grooves being located at a third set of arcs around the cylindrical part and each group of grooves being spaced away from an end of the housing by a different distance.

An advantage of the luminaire and the lamp of the first and second aspects of the disclosure is that the lamp can be mounted to the lamp holder very conveniently. In particular, the arrangement of protuberances and grooves allows the lamp to be secured to the lamp holder without the use of separate components. The provision of multiple groups of grooves spaced away from the end of the housing by different distances may also allow the lamp to be secured to the lamp holder in different positions.

The protuberances of the lamp holder may each extend inwardly from the cylindrical inner surface by extending resiliently from a hole in the cylindrical inner surface. Optionally, the protuberances each comprise a portion of a resilient member, which resilient member extends around the outside of the body. The resilient member may be a wire spring clip. Importantly, the wire spring clip may not need to be removed during mounting of the lamp in the lamp holder. Rather, the wire spring clip may remain in position to provide the protuberances.

The cylindrical inner surface of the lamp holder may have a ledge spaced away from the first end of the body of the lamp holder. When the lamp is mounted to the lamp holder at the second orientation and the protuberances are accommodated by the grooves of one of the two or more groups of grooves that is located furthest from the first end of the housing, the first end of the housing may abut the ledge. The ledge may therefore provide a supporting surface for the lamp in the lamp holder.

The luminaire may further comprise an optical element. The optical element may be a lens, cover or louvre. In some examples the optical element is transparent, but it may alternatively be translucent, e.g. frosted or of a honeycomb structure. It might alternatively or additionally be coloured.

When the lamp is mounted to the lamp holder at the second orientation and the protuberances are accommodated by one of the two or more groups of grooves that is located closer to the first end of the housing than the one of the two or more groups of grooves that is located furthest from the first end of the housing, the optical element may be secured between the first end of the housing and the ledge. Optical elements of different thicknesses, or more than one optical element, can be accommodated by providing groups of grooves at multiple different distances from the first end of the housing.

The grooves may be parallel with an imaginary plane defined by the first end of the housing. This allows the lamp to be rotated between the first orientation and the second orientation without moving axially, e.g. towards or away from the lamp holder.

The outer periphery of the cylindrical part of the housing may comprise two or more portions of the outer surface of the cylindrical part that taper towards the first end of the housing. This allows space for the protuberances to be provided as the lamp is initially moved towards to the lamp holder, but for this space to reduce as the lamp is moved further towards the lamp holder.

The first set of arcs at which the protuberances are located may have rotational symmetry around the cylindrical inner surface. The rotational symmetry may be of order two. Since the second and third sets of arcs may coincide with the first set of arcs, they may have similar symmetry. However, in other examples, the first set of arcs, along with the second and third set of arcs, have different configurations. In some examples, there is a greater order of rotational symmetry, such as rotational symmetry of order three or four. In other examples, the sets of arcs are not rotationally symmetric.

The lamp may be of any suitable type, including incandescent and halogen bulbs. However, the lamp is usually a Light Emitting Diode (LED) engine.

Preferred embodiments of the invention are described below, by way of example only, with reference to the accompanying drawings.

DESCRIPTION OF SPECIFIC EMBODIMENTS OF THE INVENTION

Figure 1:
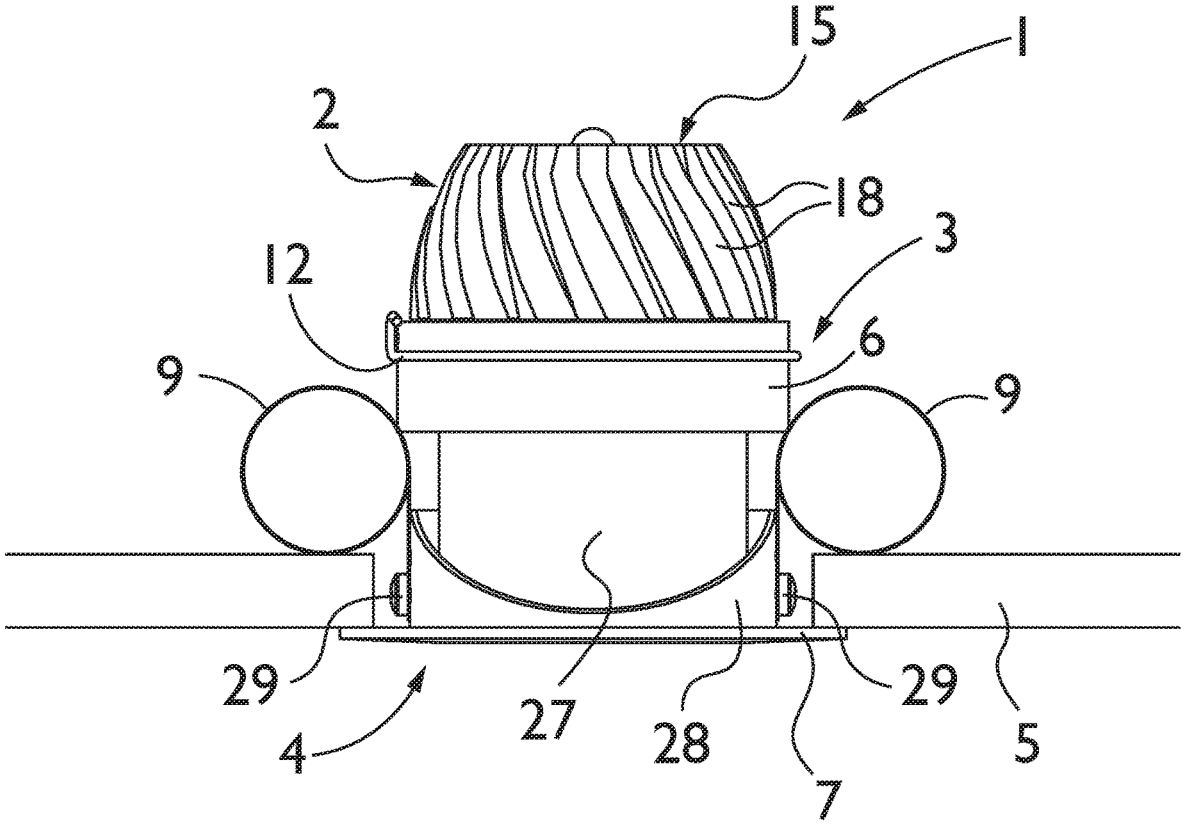
FIG. 1 is a side view of a luminaire according to an embodiment of the disclosure.
Figure 2:
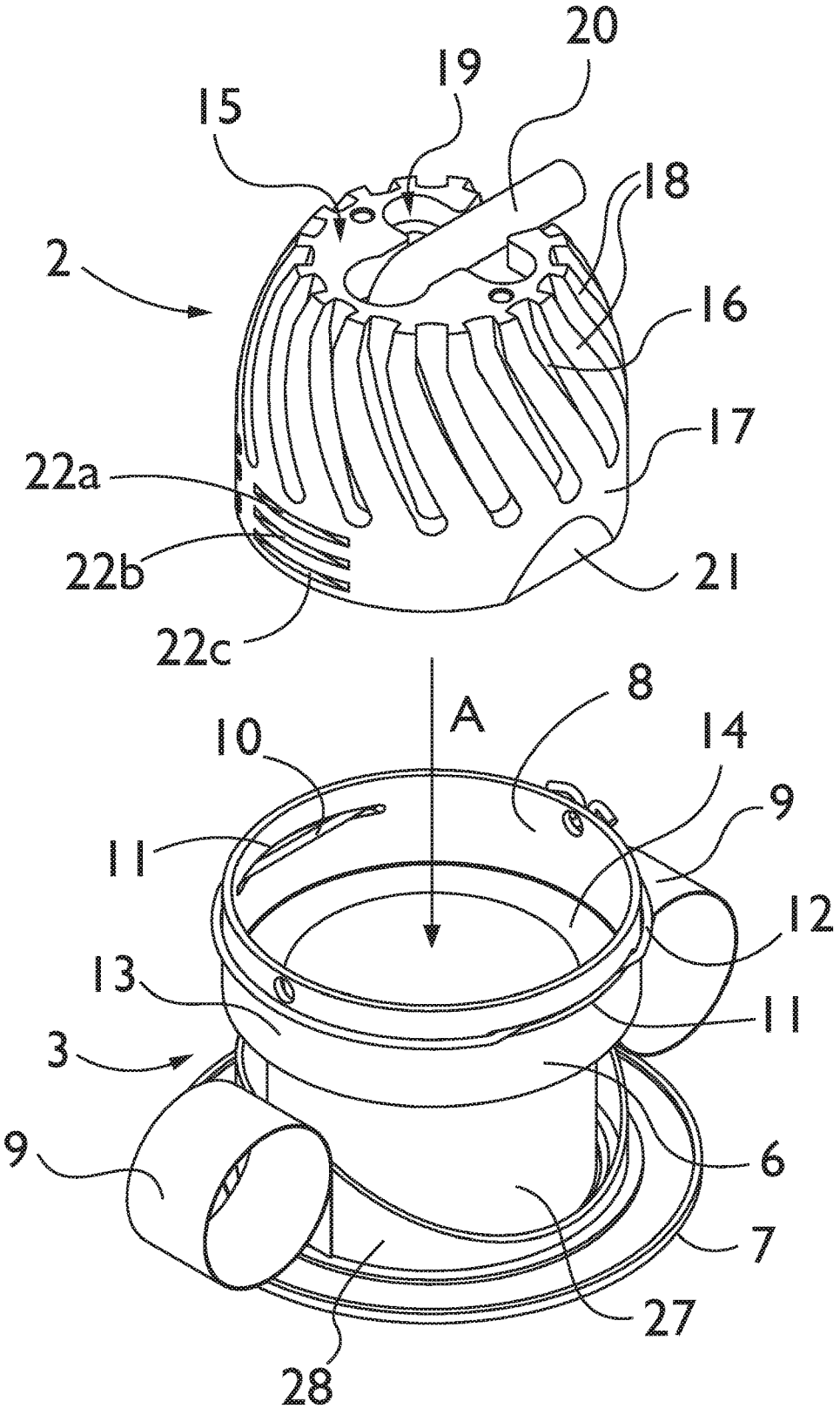
FIG. 2 is a perspective view of the luminaire, shown with a lamp removed from a lamp holder.
Figure 3:
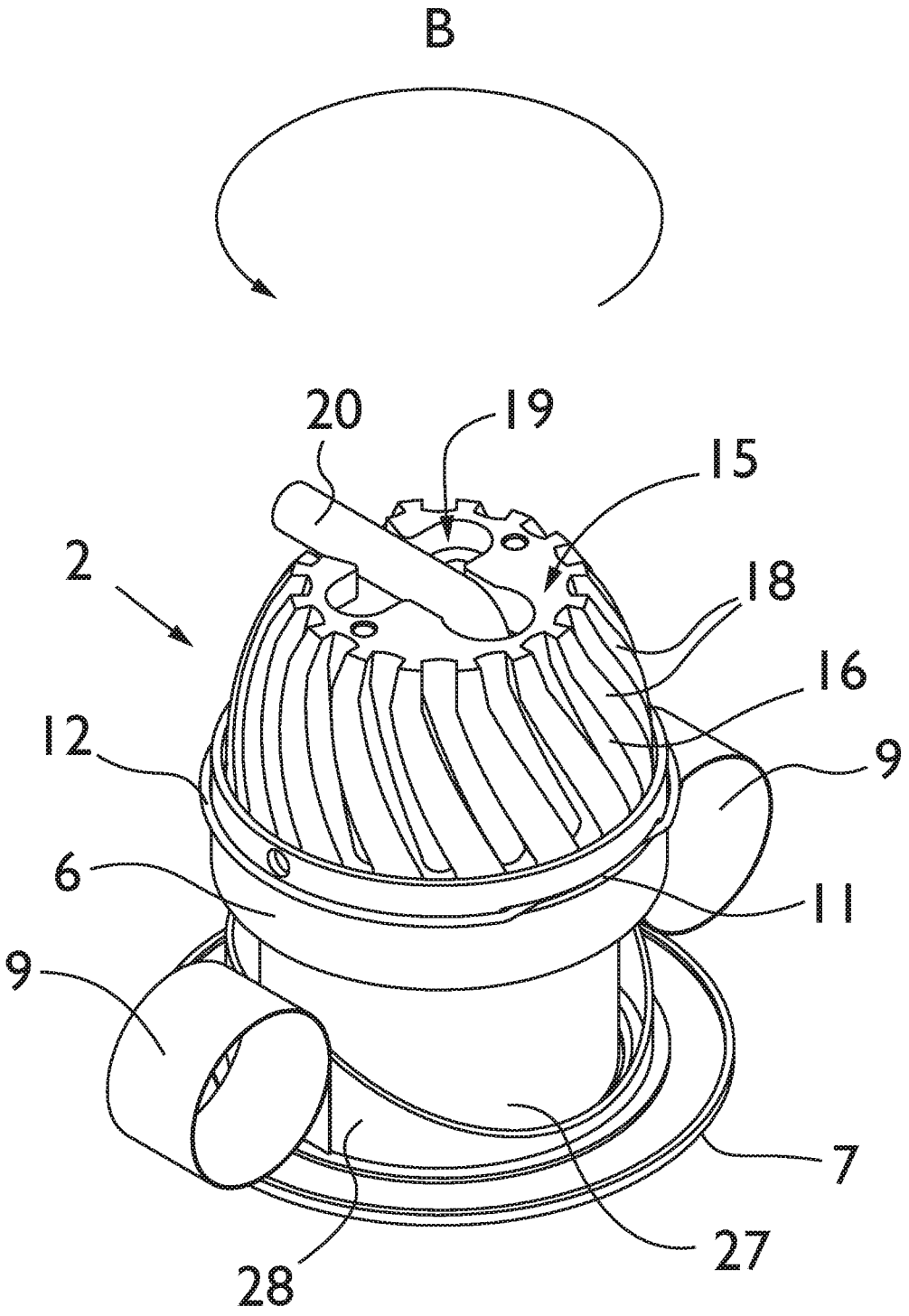
FIG. 3 is a perspective view of the luminaire, shown with the lamp mounted to the lamp holder in a first arrangement.

Referring to FIGS. 1 to 3, a luminaire 1 according to an embodiment of the disclosure comprises a lamp 2 and a lamp holder 3. In the illustrated embodiment, the luminaire 1 is a recessed light installable in a hole 4 in a panel 5. Typically, the panel 5 is a ceiling board and the luminaire 1 can be described as a recessed downlight. However, the panel 5 can be of a variety of different types, such as a board, a wall or a mount, and can be located in a variety of different settings, such as an interior or exterior of a building, a pavement, a deck, a part of a vehicle or a part of a light fixture. In different embodiments the luminaire 1 can be adapted for the relevant application.

In the present embodiment, the lamp holder 3 comprises a body 6 and a bezel 7. The body 6 is generally cylindrical, or tubular, in particular having a cylindrical inner surface 8. The bezel 7 is generally annular. In this embodiment, the body 6 and the bezel 7 are located coaxially. The lamp 2 is mountable to the lamp holder 3 at a first end of the body 6 and the bezel 7 is provided at a second end of the body 6, opposite to the first end.

The bezel 7 has a diameter greater than an outer diameter of the body 6. The hole 4 has a diameter greater than the outer diameter of the body 6 but less than that of the bezel 7. With the luminaire 1 installed in the hole 4, the body 6 extends through the hole 4 and the bezel 7 abuts the panel 5 around a periphery of the hole 4. The bezel 7 covers the periphery of hole 4 on the side of the panel 5 that the bezel 7 is located. It is from this side of the panel 5 that the luminaire 1 is typically visible when installed. With the bezel 7 arranged flush with the panel 5, the bezel 7 obscures the hole 4 and provides the luminaire 1 in its position in the panel 5 with a pleasing aesthetic.

The lamp holder 3 has a retainer for securing the luminaire 1 in the hole 4. In this embodiment, the retainer comprises one or more coil springs 9. The coil spring(s) 9 is/are secured to a side of the lamp holder 3. In this embodiment, there are two coil springs 9 arranged diametrically opposite one another on the lamp holder 3. The width of the lamp holder 3 including the coil springs 9 when wound up is greater than the width of the hole 4, or similar to the diameter of the bezel 7. This allows the panel 5 at the periphery of the hole 4 to be sandwiched between the coil springs 9 and the bezel 7 to retain the luminaire 1 in the hole 4. The coil springs 9 are oriented to unwind away from the bezel 7. This allows the luminaire 1 to be pulled out of the hole 4 by the coil springs 9 unwinding. FIG. 1 shows the coil springs 9 partially unwound when the luminaire 1 is positioned in the hole 4. In this arrangement, the coil springs 9 resiliently hold the panel 5 sandwiched between the coil springs 9 and the bezel 7, to secure the luminaire 1 in the hole 4 in the panel 5. FIGS. 2 and 3 show the coil springs 9 fully wound, without the panel 5 present.

Protuberances 10 are located around the cylindrical inner surface 8 of the body 6. The protuberances 10 extend from the cylindrical inner surface 8, inwardly towards the inside of the body 6. In this embodiment, each protuberance 10 extends from a hole 11 in the body 6. More specifically, a first protuberance 10 extends from a first hole 11 and a second protuberance 10 extends from a second hole 11. The protuberances 10 are elongate in a direction tangential to the cylindrical inner surface 8 and perpendicular to a main axis of the cylindrical inner surface 8.

The protuberances 10 extend from the holes 11 in the cylindrical inner surface 8 resiliently. That is, each protuberance 10 is biased towards a position in which it protrudes from the cylindrical inner surface 8. However, the protuberances 10 can be deflected towards the cylindrical inner surface 8, or in an outward direction, against this biasing. When deflected, the protuberances 10 recede into the holes 11.

In this embodiment, the protuberances 10 each comprise a portion of a resilient member 12. The resilient member 12 extends around an outer surface 13 of the body 6. The holes 11 are through holes, and the portions of the resilient member 12 that form the protuberances 10 extend through the holes 11 to the inside of the body 6. In this embodiment, the resilient member 12 is a wire spring clip. That is, it comprises a wire of a resilient material, such as steel, adapted to correspond with the shape of the outer surface 13 of the body 6 and to fit into the holes 11 so as to clip or snap-fit to the body 6.

The body 6 has a ledge 14 extending from the cylindrical inner surface 8. In this embodiment, the ledge 14 extends all the way around the cylindrical inner surface 8, although this is not necessary and, in other embodiments, the ledge 14 extends just part way around of the cylindrical inner surface 8, e.g. by comprising a plurality of tabs. The ledge 14 is located further away from the first end of the body 6 than the protuberances 10. In other words, the protuberances 10 are located between the ledge 14 and the first end of the body 6.

The lamp 2 has a housing 15 that comprises a heat sink 16 and a cylindrical part 17. The housing 15 is roughly cup shaped. The cylindrical part 17 is located towards a first end of the housing 15, which is the open end of the cup shape, and the heat sink 16 is located towards a second end of the housing 15, which is the closed end of the cup shape. The heat sink 16 and cylindrical part 17 are generally contiguous with one another. Indeed, in this embodiment, the heat sink 16 and cylindrical part 17 are a single piece, e.g. a cast, pressed or moulded component.

The heat sink 16 has fins 18 on an outer surface of the housing 15, and a recess 19 in which a cable 20 can be mounted. In this embodiment, the fins 18 extend in a direction from the first end to the second end of the housing 15, which direction is inclined around the circumference of the housing 15 such that each of the fins 18 extends helically around the housing 15.

The cylindrical part 17 has an outer diameter smaller than an inner diameter of the cylindrical inner surface 8 of the body 6 of the lamp holder 3. This allows the cylindrical part 17 to be inserted into a void bounded by the cylindrical inner surface 8 at the first end of the body 6. An outer surface of the cylindrical part 17, at an outer periphery adjacent to the open end of the housing 15, has a sector of reduced radius. In other words, an outer periphery of the cylindrical part 17 at the first end of the housing 15 extends radially less in a sector of the cylindrical part 17 than elsewhere around the cylindrical part 17. The sector of reduced radial extent defines a face 21 on the outer periphery of the cylindrical part 17. The face 21 can be thought of as being defined by an imaginary part cut away from the cylindrical surface. It might be referred to as a recessed, depressed or indented face. In this embodiment, the face 21 is inclined towards the first end of the housing 15. In other words, the face 21 slopes towards the first end of the housing 15, or defines a taper towards the first end of the housing 15. In other embodiments, the face 21 is parallel to a main axis of the cylindrical part 17. Two such faces 21 are provided in this embodiment, diametrically opposed to one another about the cylindrical part 17. There are therefore two sectors in which the radial extent of the cylindrical part 17 is reduced.

Three groups of grooves 22*a*, 22*b*, 22*c* are provided on the outer surface of the cylindrical part 17 of the housing 15. Each of the grooves of a group of grooves 22*a*, 22*b*, 22*c* is spaced away from the first end of the housing 15 by the same distance as the other grooves in the respective group of grooves 22*a*, 22*b*, 22*c*. The distance is different for each group of grooves 22*a*, 22*b*, 22*c*. A first group of grooves 22*a* is located furthest from the first end of the housing 15. A second group of grooves 22*b* is spaced away from the first end of the housing 15 by a distance less than the distance that the first group of grooves 22*a* is spaced away from the first end of the housing 15, that is between the first group of grooves 22*a* and the first end of the housing 15. A third group of grooves 22*c* is spaced away from the first end of the housing 15 by a distance less than the distances that the first and second groups of grooves 22*a*, 22*b* are spaced away from the first end of the housing 15, that is between the second group of grooves 22*b* and the first end of the housing 15. In other embodiments, the third group of grooves 22*c* is omitted, and there are only two groups of grooves, e.g. the first and second groups of grooves 22*a*, 22*b*. Alternatively, more than three groups of grooves 22*a*, 22*b*, 22*c* are provided, each group of grooves 22*a*, 22*b*, 22*c* being spaced away from the first end of the housing 15 by a different distance.

Figure 4C:
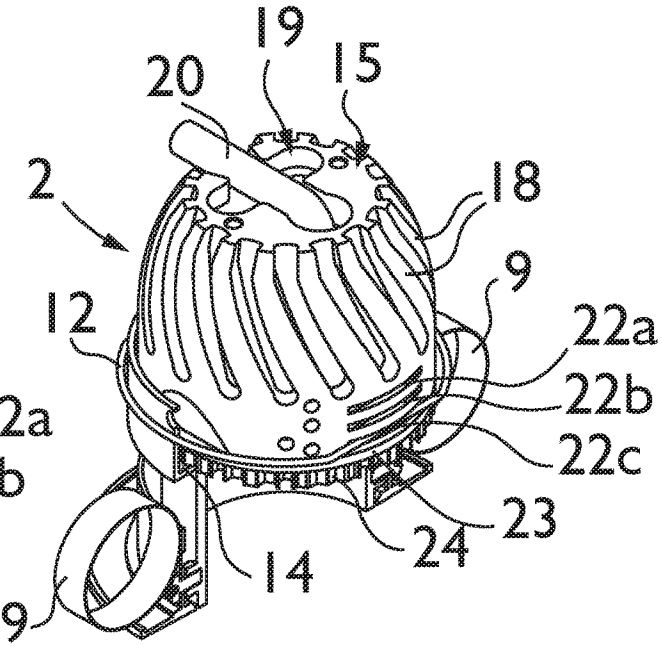
FIGS. 4A to 4C are perspective views of the luminaire with the lamp holder partially cut away, shown with the lamp mounted to the lamp holder in first, second and third arrangements respectively.
Figure 4B:
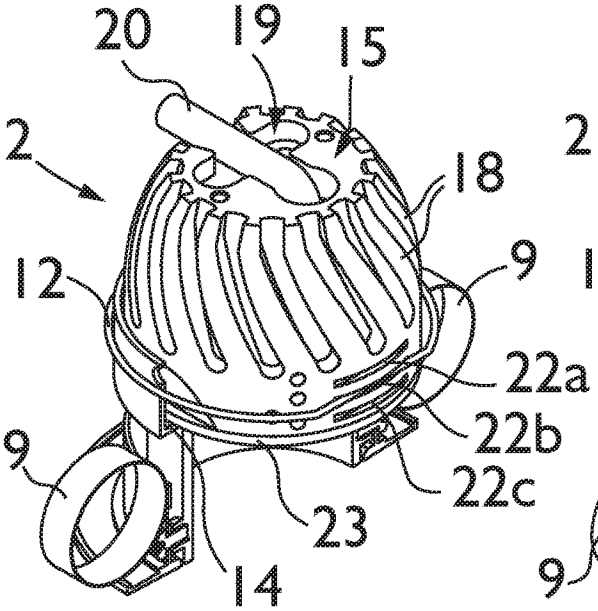
Figure 4A:
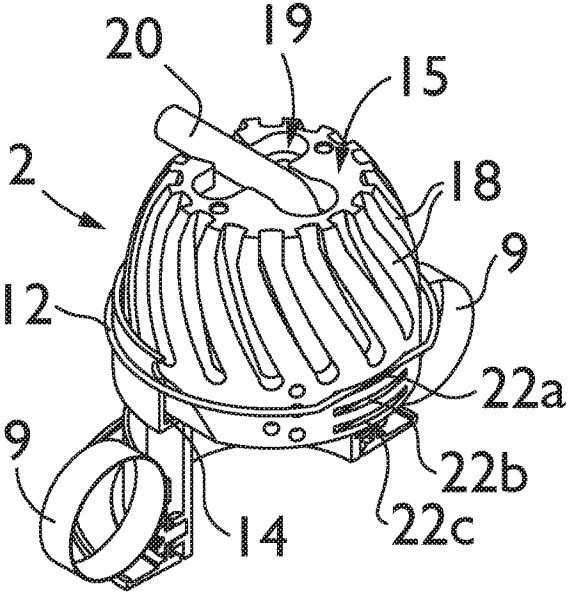

Referring to FIG. 4A, the lamp 2 can be mounted to the lamp holder 3 in a first arrangement, in which the first end of the housing 15 of the lamp 2 abuts the ledge 14 of the body 6 of the lamp holder 3 directly. Alternatively, a first optical element 23 or a second optical element 24 can be mounted between the first end of the housing 15 and the ledge 14, in a second arrangement, as shown in FIG. 4B. In another alternative, both the first optical element 23 and the second optical element 24 can be mounted between the first end of the housing 15 and the ledge 14, in a third arrangement, as shown in FIG. 4C.

A distance between the ledge 14 and the protuberances 10 is the same as the distance between the first end of the housing 15 of the lamp 2 and the first group of grooves 22*a*. Referring to FIG. 4A, when the lamp 2 is mounted with the first end of the housing 15 abutting the ledge 14 directly, this allows the protuberances 10 to be accommodated by the first group of grooves 22*a*. The distance between the ledge 14 and the protuberances 10 is also the same as a distance between the first end of the housing 15 of the lamp 2 and the second group of grooves 22*b* plus the thickness of either the first optical element 23 or the second optical element 24. Referring to FIG. 4B, when the lamp 2 is mounted with the first optical element 23 or the second optical element 24 between the first end of the housing 15 and the ledge 14, this allows the protuberances 10 to be accommodated by the second group of grooves 22*b*. Finally, the distance between the ledge 14 and the protuberances 10 is also the same as a distance between the first end of the housing 15 of the lamp 2 and the third group of grooves 22*c* plus the thicknesses of the first optical element 23 and the second optical element 24 together. Referring to FIG. 4C, when the lamp 2 is mounted with the first optical element 23 and the second optical element 24 between the first end of the housing 15 and the ledge 14, this allows the protuberances 10 to be accommodated by the third group of grooves 22*c*.

In this embodiment, the grooves of the first, second and third groups of grooves 22*a*, 22*b*, 22*c* are all parallel with one another. They are also parallel with a surface of the first end of the housing 15, which surface abuts the ledge 14 in the first arrangement and abuts the first or second optical element 23, 24 in the second and third arrangements. In this embodiment, the surface is planar, and the plane of the surface is perpendicular to a central axis of the cylindrical part 17. In other embodiments, the surface is defined by multiple parts, such as protrusions on the first end of the housing 15. However, the grooves remain parallel to the plane defined by the surface. More specifically, the grooves extend perpendicularly to the axis around which the lamp 2 and lamp holder 3 rotate between the first and second orientations. In most embodiments, the surface is perpendicular to this axis, since the surface slides over the ledge 14 or one of the first and second optical elements 23, 24 as the lamp 2 and lamp holder 3 rotate between the first and second orientations.

Figure 5:
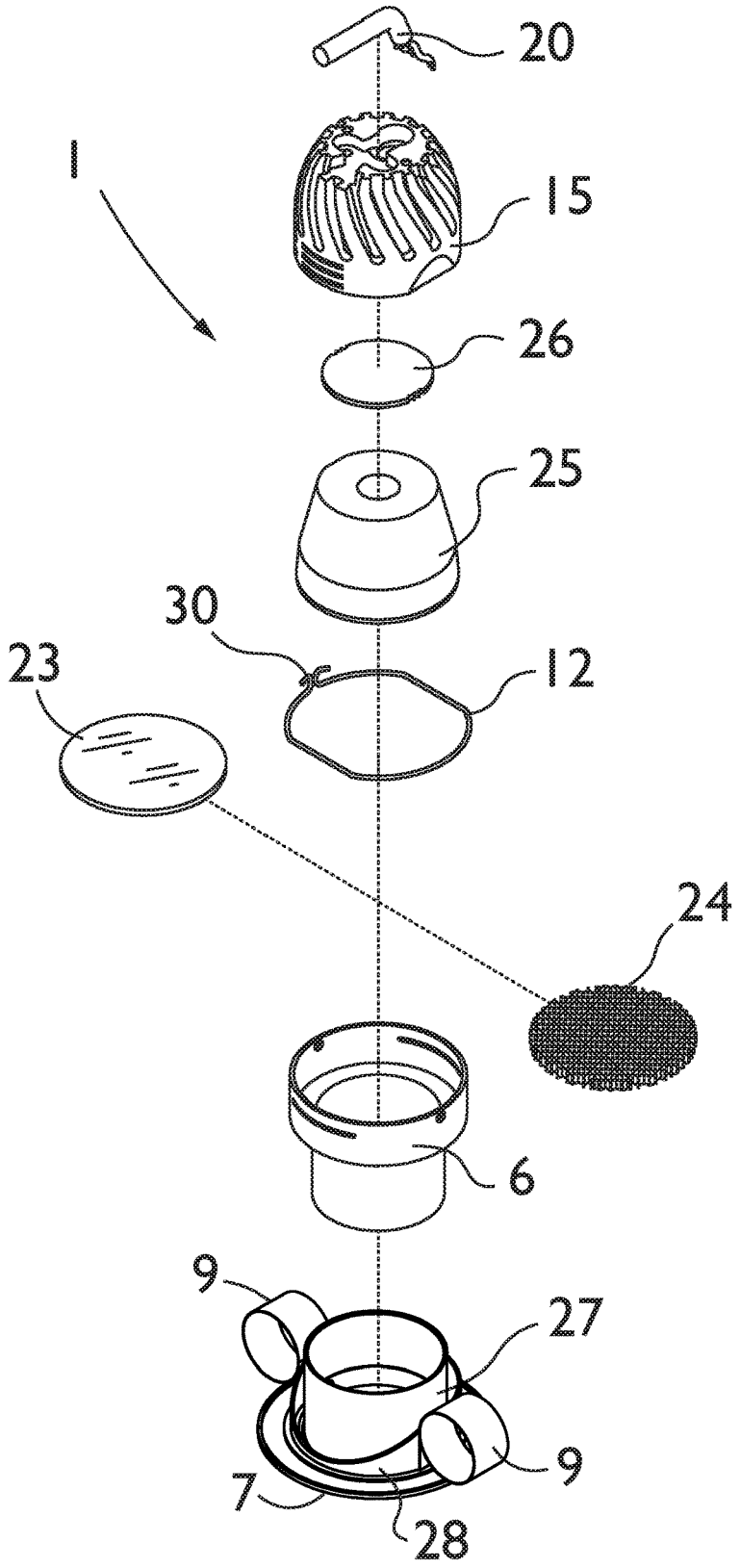
FIG. 5 is an exploded perspective view of the luminaire.

Further details of the construction of the luminaire 1 of the illustrated embodiment can be seen in FIG. 5, which is an exploded perspective view of the luminaire 1. The housing 15 of the lamp 2 accommodates various components that function to provide illumination when the lamp 2 is supplied with electricity. In this embodiment, the lamp 2 is a Light Emitting Diode (LED) engine. An LED (not shown) is mounted on a Printed Circuit Board (PCB), which in turn is mounted in an optical component 25. The optical component 25 is arranged to direct light from the LED, and typically comprises a reflective surface surrounding the LED and a lens in front of the LED. In this embodiment, the lens is translucent rather than transparent, to diffuse light emitted from the LED. A thermal interface 26 is provided between the optical component 25 and the housing 15, and optical component 25 and thermal interface 26 are mounted in the housing 15.

A baffle 27 extends around the body 6 of the lamp holder 3. It can be seen in FIG. 5 that the body 6 has a smaller diameter towards the second end of the lamp holder 3 than towards the first end of the lamp holder 3. A step change in the diameter between the first end and the second end provides the ledge 14. The baffle 27 is located towards the second end of the lamp holder 3, between the ledge 14 and the second end. In this embodiment, the baffle 27 comprises a hollow cylinder open at each end, and having a diameter larger than the diameter of body 6 towards the second end of the body 6 and similar to that of the body 6 towards the first end of the body 6.

The bezel 7 has a socket 28 for receiving the body 6 and baffle 27. The socket 28 comprises a cylindrical wall standing on the bezel 7. The cylindrical wall has a diameter larger than that of the baffle 27. The body 6, baffle 27 and cylindrical wall of the socket 28 are arranged coaxially and secured to one another by a fastener. In this embodiment, the fastener also holds the coil springs 9 in place. In more detail, the fastener comprises two bolts 29. Two holes are provided in each of the cylindrical wall of the socket 28, the baffle 27 and the body 6, diametrically opposed to one another on each of the cylindrical wall of the socket 28, the baffle 27 and the body 6 respectively and arranged to line up with one another when the socket 28, the baffle 27 and the body 6 are mounted to one another. Each bolt 29 passes through a hole in one end of one of the coil springs 9 then through the holes in the cylindrical wall of the socket 28, the baffle 27 and the body 6. In this embodiment, spacers (not shown) are provided on the bolts 29 between the cylindrical wall of the socket 28 and the baffle 27 and between the baffle 27 and the body 6 to hold the socket 28 and the baffle 27 apart from one another and the baffle 27 and the body 6 apart from one another.

The shape of the resilient member 12 can be seen more clearly in FIG. 5. It is generally circular, except at the two portions that form the protuberances 10. At these two portions the resilient member 12 is straight. In this embodiment, the resilient member 12 has a gap 30 along its length. The gap 30 allows the resilient member to flex, with the gap 30 opening when the resilient member 12 flexes outwardly and closing when the resilient member 12 returns to its un-flexed shape.

It can also be seen that the first optical element 23 is a transparent sheet, although in some embodiments, the first optical element 23 is frosted or coloured. The second optical element 24 is a honeycomb louvre.

Figure 6:
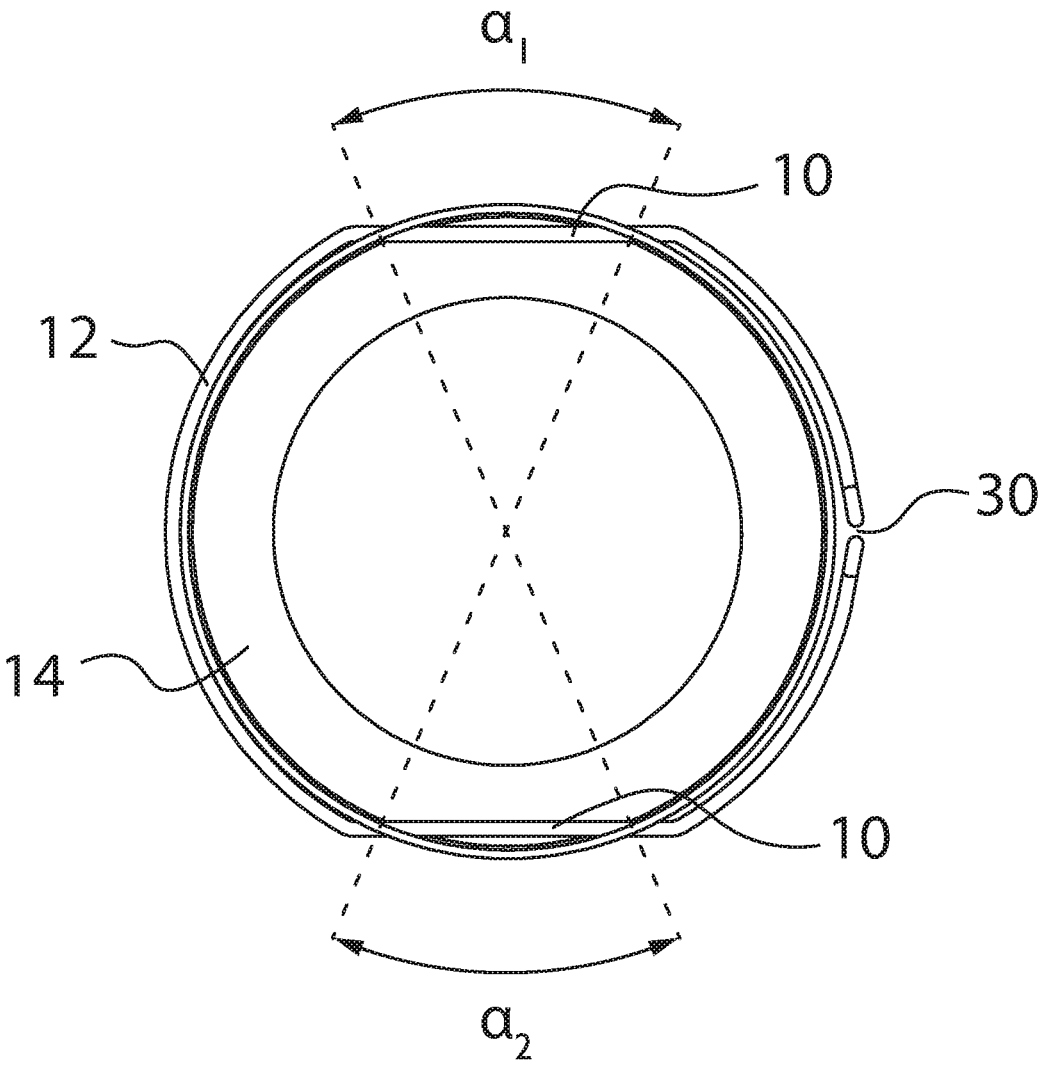
FIG. 6 is a top view of a body of the lamp holder.
Figure 7:
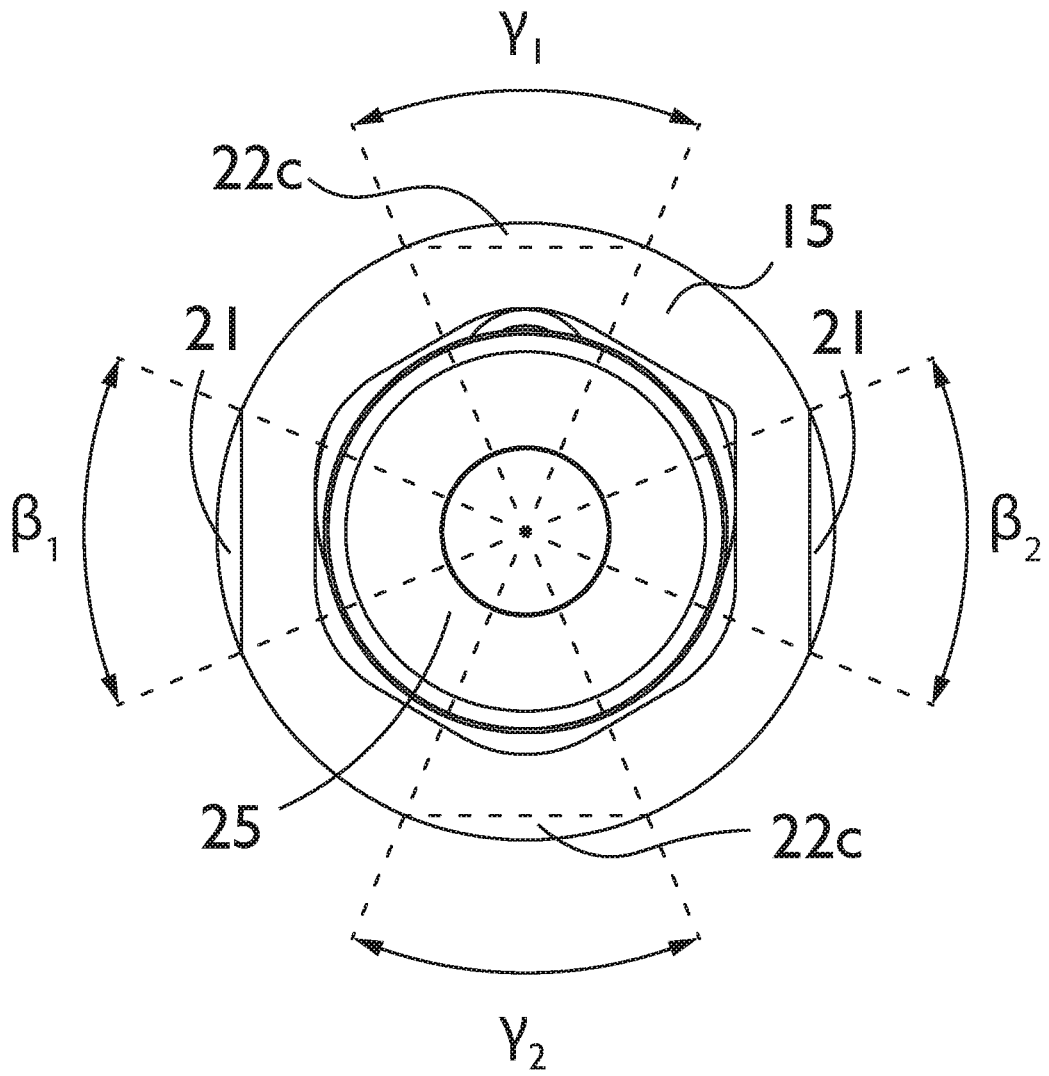
FIG. 7 is a bottom view of a housing of the lamp.

Correspondence between the locations of the faces 21, the locations of the grooves of the groups of grooves 22*a*, 22*b*, 22*c* and the locations of the protuberances 10 can be seen more clearly in FIGS. 6 and 7.

Referring to FIG. 6, the protuberances 10 are located at a first set of arcs $\alpha_1$, $\alpha_2$ around the cylindrical inner surface 8 of the body 6. Each of the arcs of the first set of arcs $\alpha_1$, $\alpha_2$ defines the angular extent of one of the protuberances 10 over the cylindrical inner surface 8 when the protuberance 10 is not deflected into the holes 11. In this embodiment, there are two protuberances 10, and hence two arcs in the first set of arcs $\alpha_1$, $\alpha_2$. One of the arcs, or a first arc $\alpha_1$, is diametrically opposite the other of the arcs, or a second arc $\alpha_2$. That is, the first arc $\alpha_1$ is 180 degrees from the second arc $\alpha_1$. The protuberances 10, and hence the arcs of the first set of arcs $\alpha_1$, $\alpha_2$ are also the same size. In other words, the first set of arcs $\alpha_1$, $\alpha_2$ around the cylindrical inner surface 8 of the body 6 has rotational symmetry of order two.

Referring to FIG. 7, the radial extent of the outer periphery of the cylindrical part 17 of the housing 15 is reduced in sectors of the cylindrical part 17 to provide the faces 21. The sectors of reduced radial extent are defined by a second set of arcs $\beta_1$, $\beta_2$. In this embodiment, there are two faces 21 and hence two sectors of reduced radial extent and two arcs in the second set of arcs $\beta_1$, $\beta_2$. One of the arcs, or a first arc $\beta_1$, is diametrically opposite the other of the arcs, or a second arc $\beta_2$. That is, the first arc $\beta_1$ is 180 degrees from the second arc $\beta_1$. The faces 21, and hence the sectors of reduced radial extent and the arcs of the second set of arcs $\beta_1$, $\beta_2$ are the same size. In other words, the second set of arcs $\beta_1$, $\beta_2$ around the outer periphery of the cylindrical part 17 of the housing 15 has rotational symmetry of order two.

Still referring to FIG. 7, the grooves of the groups of grooves 22*a*, 22*b*, 22*c* in the outer surface of the cylindrical part 17 of the housing 15 are located at a third set of arcs $\gamma_1$, $\gamma_2$. One groove of each of the groups of grooves 22*a*, 22*b*, 22*c* is located in each arc of the third set of arcs $\gamma_1$, $\gamma_2$. The grooves each have the same angular extent around the cylindrical part 17. In this embodiment, there are two grooves in each group of grooves 22*a*, 22*b*, 22*c*, and hence two arcs in the third set of arcs $\gamma_1$, $\gamma_2$. One of the arcs, or a first arc $\gamma_1$, is diametrically opposite the other of the arcs, or a second arc $\gamma_2$. That is, the first arc $\gamma_1$ is 180 degrees from the second arc $\gamma_2$. In other words, the third set of arcs $\gamma_1$, $\gamma_2$ around the outer surface of the cylindrical part 17 of the housing 15 has rotational symmetry of order two.

The arcs of the second set of arcs $\beta_1$, $\beta_2$ are offset from the arcs of the third set of arcs $\gamma_1$, $\gamma_2$. In this embodiment, the arcs of the second set of arcs $\beta_1$, $\beta_2$ are completely offset from the arcs of the third set of arcs $\gamma_1$, $\gamma_2$, so that the faces 21 and the grooves of the sets of grooves 22*a*, 22*b*, 22*c* do not overlap one another around the circumference of the cylindrical part 17. More specifically, the arcs of the second set of arcs $\beta_1$, $\beta_2$ are offset from the arcs of the third set of arcs $\gamma_1$, $\gamma_2$ by 90 degrees. In other words, they are perpendicular, or at a right angle, to one another around the cylindrical part 17. Since there are two arcs in the second set of arcs $\beta_1$, $\beta_2$ and two arcs in the third set of arcs $\gamma_1$, $\gamma_2$, this means that there is an arc of the second set of arcs $\beta_1$, $\beta_2$ or the third set of arcs $\gamma_1$, $\gamma_2$ every 90 degrees around the cylindrical part 17, with the arcs of the second set of arcs $\beta_1$, $\beta_2$ alternating with the arcs of the third set of arcs $\gamma_1$, $\gamma_2$.

In this embodiment, the angular extent of each of the arcs of the first set of arcs $\alpha_1$, $\alpha_2$, the second set of arcs $\beta_1$, $\beta_2$ and the third set of arcs $\gamma_1$, $\gamma_2$ is approximately the same. More specifically, each arc is around 30 degrees. However, the angular extent of the arcs differs in other embodiments. In many embodiments, the angular extent of the arcs of the first set of arcs $\alpha_1$, $\alpha_2$ is different from the angular extent of the arcs of the second set of arcs $\beta_1$, $\beta_2$ which in turn is different to the angular extent of the arcs of the third set of arcs $\gamma_1$, $\gamma_2$. In particular, the angular extent of the arcs of the first set of arcs $\alpha_1$, $\alpha_2$, defining the extent of the protuberances 10, is the smallest in most embodiments.

The lamp 2 is mountable to the lamp holder 3 at a first orientation, as shown in FIG. 2. In the first orientation, the protuberances 10 coincide with the faces 21. In other words, the arcs of the first set of arcs $\alpha_1$, $\alpha_2$ coincide with the arcs of the second set of arcs $\beta_1$, $\beta_2$. In this orientation, the faces 21 provide space between the cylindrical part 17 and the inner cylindrical surface 8 for the protuberances 10.

The lamp 2 is rotatable relative to the lamp holder 3 from the first orientation to a second orientation, which second orientation is shown in FIG. 3. In the second orientation, the protuberances 10 coincide with the grooves of one of the sets of grooves 22*a*, 22*b*, 22*c*. In other words, the arcs of the first set of arcs $\alpha_1$, $\alpha_2$ coincide with the arcs of the third set of arcs $\gamma_1$, $\gamma_2$. In this orientation, the protuberances 10 are accommodated in the grooves of one of the sets of grooves 22*a*, 22*b*, 22*c* and the lamp 2 is secured in the lamp holder 3.

In order to install the luminaire 1, a user connects the lamp 2 to an electrical supply using the cable 20. Typically, an end (not shown) of the cable 20 distal from the lamp 2 incorporates a connector suitable for coupling to an electrical supply.

The user decides whether or not to use the first and/or second optical element 23, 24. If it is decided to use the first and/or second optical element 23, 24, the user inserts the chosen optical element(s) 23, 24 into the lamp holder 3, by resting the optical element(s) 23, 24 on the ledge 14 of the body 6. If neither of the first or second optical elements 23, 24 is to be used, this step is omitted.

The user then mounts the lamp 2 to the lamp holder 3. More specifically, the user inserts the cylindrical part 17 of the housing 15 of the lamp 2 into the void bounded by the cylindrical inner surface 8 of the body 6 of the lamp holder 3 by moving the lamp 2 and lamp holder 3 towards one another in the direction of arrow A shown in FIG. 2. The lamp 2 is maintained in the first orientation with respect to the lamp holder 3. That is, the protuberances 10 are oriented to coincide with the faces 21, or such that the arcs of the first set of arcs $\alpha_1$, $\alpha_2$ coincide with the arcs of the second set of arcs $\beta_1$, $\beta_2$. As the cylindrical part 17 is inserted into the void, space between the faces 21 and the inner cylindrical surface 8 initially accommodates the protuberances 10. As the cylindrical part 17 is inserted further into the void, the space between the faces 21 and the inner cylindrical surface 8 reduces due to the taper of the faces 21. This means that the faces 21 urge the protuberances 10 so that they deflect towards the inner cylindrical surface 8. This deflection is against the biasing of the protuberances 10, and is accommodated by the protuberances receding into the holes 11 in the inner cylindrical surface 8. Eventually, the first end of the housing 15 of the lamp 2 comes to rest against the ledge 14 or, if the first and/or second optical elements 23, 24 have been used, then the first end of the housing 15 of the lamp 2 comes to rest against the first or second optical elements 23, 24 to hold the first and/or second optical element 23, 24 between the first end of the housing 15 and the ledge 14.

Next, the lamp 2 and lamp holder 3 are rotated relative to one another from the first orientation to the second orientation. This can be achieved by rotating the lamp 2 in the direction of arrow B in FIG. 3. However, it will be appreciated that rotation in the opposite direction to that shown in arrow B can achieve the same result. All that is important is that the rotation is in a plane parallel to the planes of the first end of the housing 15 and the grooves of the first, second and third groups of grooves 22*a*, 22*b*, 22*c*. In this embodiment, a rotation of 90 degrees is required to move the lamp 2 and lamp holder 3 from the first orientation to the second orientation. As the lamp 2 and the lamp holder 3 are rotated, the protuberances 10 slide into one of the sets of grooves 22*a*, 22*b*, 22*c*. If neither the first or the second optical element 23, 24 has been used, then the protuberances 10 slide into the grooves of the first set of grooves 22*a*. If just the first or the second optical element 23, 24 has been used, then the protuberances 10 slide into the grooves of the second set of grooves 22*b*. If both the first and the second optical element 23, 24 have been used, then the protuberances 10 slide into the grooves of the third set of grooves 22*c*. With the protuberances 10 in the grooves of one of the sets of grooves 22*a*, 22*b*, 22*c*, the lamp 2 is secured to the lamp holder 3.

Finally, the luminaire 1 can be inserted into the hole 4 in the panel 5. Typically this requires the user to insert the luminaire 1 obliquely to the hole 4 so that one of the coil springs 9 passes through the hole 4 before the other. It may also be that the coil springs 9 are deflected as they pass through the hole 4. However, the bezel 7 is too wide to pass through the hole 4 and, once the coil springs 9 have passed through the hole 4, they come to rest against a surface of the panel 5 on the other side of the panel 5 to the bezel 7. The luminaire 1 is thus held in the hole 4, as shown in FIG. 1.

The luminaire 1 can be removed from the panel 5 by pulling the bezel 7 away from the panel 5. This causes the coil springs 9 to unwind and further manipulation of the luminaire 1 can allow it to be extracted from the hole 4. This allows the lamp 2 to be replaced, or the first and/or second optical elements 23, 24 to be added, removed or replaced.

It will be appreciated that the illustrated embodiment represents just one way in which the ideas outlined in this disclosure may be implemented. Variations and modifications to the illustrated embodiment will occur to the skilled person. In particular, the number of protuberances 10, faces 21 and grooves in each of the sets of grooves 22*a*, 22*b*, 22*c* may be different to that described, and their extent around the cylindrical inner surface 8 and cylindrical part 17 may be different to that described. In one embodiment, there are three protuberances 10, three faces 21 and three grooves in each set of grooves 22*a*, 22*b*, 22*c*. The first set of arcs $\alpha_1$, $\alpha_2$, second set of arcs $\beta_1$, $\beta_2$ and third set of arcs $\gamma_1$, $\gamma_2$ therefore each comprise three arcs. These might each be spaced evenly, offset by 120 degrees. Thus, each of the first set of arcs $\alpha_1$, $\alpha_2$, the second set of arcs $\beta_1$, $\beta_2$ and third set of arcs $\gamma_1$, $\gamma_2$ may have rotational symmetry of order three. In another embodiment, there are four protuberances 10, four faces 21 and four grooves in each set of grooves 22*a*,

22*b*, 22*c*. The first set of arcs $\alpha_1$, $\alpha_2$, second set of arcs $\beta_1$, $\beta_2$ and third set of arcs $\gamma_1$, $\gamma_2$ therefore each comprise four arcs. These might each be spaced evenly, offset by 90 degrees. Thus, each of the first set of arcs $\alpha_1$, $\alpha_2$, the second set of arcs $\beta_1$, $\beta_2$ and third set of arcs $\gamma_1$, $\gamma_2$ may have rotational symmetry of order four. In yet other embodiments, there may be fewer protuberances 10 than faces 21 and grooves in the sets of grooves 22*a*, 22*b*, 22*c*, e.g. two protuberances 10, four faces 21 and four grooves. These are, of course, just some of the possible variations, with many others being possible.

What is claimed is:

1. A luminaire comprising lamp holder and a lamp mountable to the lamp holder, wherein the lamp holder comprises:

a body with a cylindrical inner surface open at a first end of the body; and protuberances located at a first set of arcs around the cylindrical inner surface, each protuberance extending inwardly from the cylindrical inner surface, and wherein the lamp comprises:

a light source;

a housing to which the light source is mounted, the housing comprising a cylindrical part, an outer periphery of the cylindrical part at a first end of the housing extending radially less at a second set of arcs around the outer periphery of the cylindrical part than elsewhere around the outer periphery of the cylindrical part; and two or more groups of grooves in an outer surface of the cylindrical part, the grooves being located at a third set of arcs around the cylindrical part and each group of grooves being spaced away from the first end of the housing by a different distance, the second set of arcs coinciding with the first set of arcs when the lamp is mounted to the lamp holder at a first orientation and the third set of arcs coinciding with the first set of arcs when the lamp is mounted to lamp holder at a second orientation, such that the outer periphery of the cylindrical part extending radially less at the second set of arcs around the outer periphery of the cylindrical part than elsewhere around the outer periphery of cylindrical part facilitates insertion of the cylindrical part into the first end of the body at the first orientation by providing space for the protuberances between the cylindrical part and the cylindrical inner surface, and when the lamp is rotated in the lamp holder from the first orientation to the second orientation the grooves of one of the groups of grooves accommodate the protuberances to secure the lamp to the lamp holder;

wherein the cylindrical inner surface of the lamp holder has a ledge spaced away from the first end of the body of the lamp holder; and wherein, when the lamp is mounted to the lamp holder at the second orientation and the protuberances are accommodated by the grooves of one of the two or more groups of grooves that is located furthest from the first end of the housing, the first end of the housing abuts the ledge.

2. The luminaire of claim 1, wherein the protuberances each extend inwardly from the cylindrical inner surface by extending resiliently from a hole in the cylindrical inner surface.

3. The luminaire of claim 2, wherein the protuberances each comprise a portion of a resilient member, which resilient member extends around the outside of the body.

4. The luminaire of claim 3, wherein the resilient member is a wire spring clip.

5. The luminaire of claim 1, further comprising an optical element and wherein, when the lamp is mounted to the lamp holder at the second orientation and the protuberances are accommodated by one of the two or more groups of grooves that is located closer to the first end of the housing than (the) one of the two or more groups of grooves that is located furthest from the first end of the housing, the optical element is secured between the first end of the housing and the ledge.

6. The luminaire of claim 1, wherein the grooves are parallel with an imaginary plane defined by the first end of the housing.

7. The luminaire of claim 1, wherein two or more portions of the outer surface of the cylindrical part of the lamp taper towards the first end of the housing so as to urge the protuberances of the lamp holder towards the cylindrical inner surface of the lamp holder when the lamp is inserted into the lamp holder.

8. The luminaire of claim 1, wherein the first set of arcs at which the protuberances are located has rotational symmetry around the cylindrical inner surface.

9. The luminaire of claim 1, wherein the first set of arcs at which the protuberances are located has rotational symmetry of order two around the cylindrical inner surface.

10. The luminaire of claim 1, wherein the lamp is a Light Emitting Diode (LED) engine.

11. A lamp for mounting to a lamp holder, the lamp comprising:

a light source;

a housing to which the light source is mounted, the housing comprising a cylindrical part, an outer periphery of the cylindrical part at a first end of the housing extending radially less at a second set of arcs around the outer periphery of the cylindrical part than elsewhere around the outer periphery of the cylindrical part; and two or more groups of grooves in the outer surface of the cylindrical part, the grooves being located at a third set of arcs around the cylindrical part and each group of grooves being spaced away from an end of the housing by a different distance;

wherein the lamp is arranged to be mounted within a lamp holder comprising: a body with a cylindrical inner surface open at a first end of the body; and protuberances located at a first set of arcs around the cylindrical inner surface, each protuberance extending inwardly from the cylindrical inner surface; wherein the cylindrical inner surface of the lamp holder has a ledge spaced away from the first end of the body of the lamp holder;

wherein the second set of arcs is arranged to coincide with the first set of arcs when the lamp is mounted to the lamp holder at a first orientation and the third set of arcs is arranged to coincide with the first set of arcs when the lamp is mounted to the lamp holder at a second orientation, such that the outer periphery of the cylindrical part extends radially less at the second set of arcs around the outer periphery of the cylindrical part than elsewhere around the outer periphery of cylindrical part and thereby facilitates insertion of the cylindrical part into the first end of the body at the first orientation by providing space for the protuberances between the cylindrical part and the cylindrical inner surface, and when the lamp is rotated in the lamp holder from the first orientation to the second orientation the grooves of one of the groups of grooves accommodate the protuberances to secure the lamp to the lamp holder; and wherein, when the lamp is mounted to the lamp holder at the second orientation and the protuberances are accommodated by the grooves of one of the two or more groups of grooves that is located furthest from the first end of the housing, the first end of the housing abuts the ledge.

* * * * *